US009773463B2

(12) United States Patent
Li et al.

(10) Patent No.: US 9,773,463 B2
(45) Date of Patent: Sep. 26, 2017

(54) METHOD OF ADJUSTING DISPLAY DEVICE DRIVING VOLTAGE AND DISPLAY DEVICE

(71) Applicants: XIAMEN TIANMA MICRO-ELECTRONICS CO., LTD., Xiamen (CN); TIANMA MICRO-ELECTRONICS CO., LTD., Shenzhen (CN)

(72) Inventors: Yuan Li, Xiamen (CN); Yi Du, Xiamen (CN)

(73) Assignees: XIAMEN TIANMA MICRO-ELECTRONICS CO., LTD., Xiamen (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 92 days.

(21) Appl. No.: 14/272,519

(22) Filed: May 8, 2014

(65) Prior Publication Data

US 2015/0154929 A1 Jun. 4, 2015

(30) Foreign Application Priority Data

Dec. 3, 2013 (CN) ..... 2013 1 0642111

(51) Int. Cl.
*G09G 3/36* (2006.01)

(52) U.S. Cl.
CPC ... *G09G 3/3611* (2013.01); *G09G 2320/0233* (2013.01); *G09G 2320/0271* (2013.01); *G09G 2320/0693* (2013.01)

(58) Field of Classification Search
CPC ..... G09G 3/3611; G09G 2320/0233; G09G 2320/0693; G09G 2320/0285;
(Continued)

(56) References Cited

U.S. PATENT DOCUMENTS 5,471,229 A * 11/1995 Okada ..... G09G 3/3637 345/101
2004/0140985 A1 7/2004 Liaw
(Continued)

FOREIGN PATENT DOCUMENTS

CN 101221735 A 7/2008
CN 102426816 A 4/2012
(Continued)

OTHER PUBLICATIONS

The first Office Action issued on Sep. 11, 2015 in the CN counterpart application (201310642111.8).

*Primary Examiner* — Amare Mengistu
*Assistant Examiner* — Stacy Khoo
(74) *Attorney, Agent, or Firm* — Kilpatrick Townsend & Stockton LLP

(57) ABSTRACT

The present invention discloses methods of adjusting display device driving voltage and a display device, which are used for improving pressing unevenness (Trace Mura) of the display device caused by pressing or paddling. The method comprises: comparing the driving voltage of a display device with a driving voltage threshold; and if the driving voltage is larger than the driving voltage threshold, adjusting the driving voltage to make the adjusted driving voltage be smaller than or equal to the driving voltage threshold.

7 Claims, 4 Drawing Sheets

(58) Field of Classification Search
CPC ... G09G 2320/0626; G09G 2320/0276; G09G 3/3696; G09G 5/10; G09G 3/361
USPC ..... 345/77, 87–104, 690–697; 348/246–247; 349/192
See application file for complete search history.

(56) References Cited

U.S. PATENT DOCUMENTS

2007/0262967 A1* 11/2007 Rho ..... G02F 1/13338 345/173
2008/0117165 A1* 5/2008 Machida ..... G09G 3/3446 345/107
2008/0158240 A1* 7/2008 Huang ..... G09G 3/3648 345/589
2010/0220068 A1* 9/2010 Chen ..... G02F 1/13338 345/173
2013/0235011 A1* 9/2013 Lin ..... G09G 3/3648 345/211
2014/0085172 A1* 3/2014 Wu ..... G09G 3/2092 345/84

FOREIGN PATENT DOCUMENTS

CN 102855856 A 1/2013
CN 103198801 A 7/2013
DE 102007040378 A1 6/2008

* cited by examiner

METHOD OF ADJUSTING DISPLAY DEVICE DRIVING VOLTAGE AND DISPLAY DEVICE

RELATED APPLICATION INFORMATION

This application claims priority to Chinese Patent Application No. 201310642111.8, entitled "METHODS OF ADJUSTING DISPLAY DEVICE DRIVING VOLTAGE AND DISPLAY DEVICE", filed with the State Intellectual Property Office of People's Republic of China on Dec. 3, 2013, the content of which is incorporated herein by reference in its entirety.

BACKGROUND OF THE INVENTION

Conventional display devices often have the defect of display unevenness (e.g., sometimes referred to as "Mura" or "Trace Mura") in a part of display regions, Mura is a poor display severely affecting the quality of the picture, the severity and duration of Mura are related to many factors, one is process parameter of the panel, such as liquid crystal, orientation layer, and the like, and the other is the setting of driving conditions. Experimental results show that white state voltage of the liquid crystal is reduced to effectively reduce the severity of the Mura and shorten its duration, wherein the white state voltage refers to the driving voltage of the display device corresponding to the maximal brightness.

The white state voltage of the liquid crystal is reduced to improve the Mura, but certain negative effects shall also be brought. As shown in FIG. 1, the transmittance shall be reduced due to the reduction of the white state voltage, namely, the maximal brightness is reduced, and meanwhile, the reduction of the maximal brightness means contrast reduction. With the reduction of the white state voltage, the variation of the driving voltage of each average grey scale is decreased, so that more accurate driving voltage of the display device is needed, which makes a driver integrated circuit (Driver IC) face more severe working conditions.

To sum up, in the prior art, the white state voltage of the liquid crystal is reduced to improve the Mura, but the maximal brightness shall be reduced, and meanwhile, the driver integrated circuit will face more severe working conditions.

DETAILED DESCRIPTION

The present invention relates to the technical field of displays, in particular to a method of adjusting display device driving voltage and a display device.

The embodiment of the present invention provides a method of adjusting display device driving voltage and a display device, which are used for improving Trace Mura of the display device caused by pressing or paddling.

Detailed description is given below on the technical scheme provided by a specific embodiment of the present invention.

Figure 1:
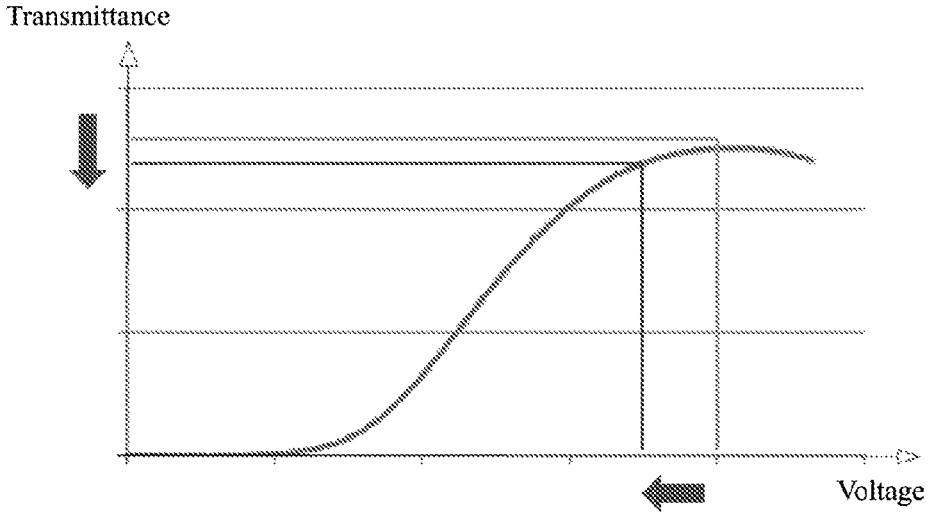
Fig.1 Prior Art
FIG. 1 is a simplified schematic diagram of improving Mura appearing in the display device by reducing the white state voltage in the prior art.
Figure 2:
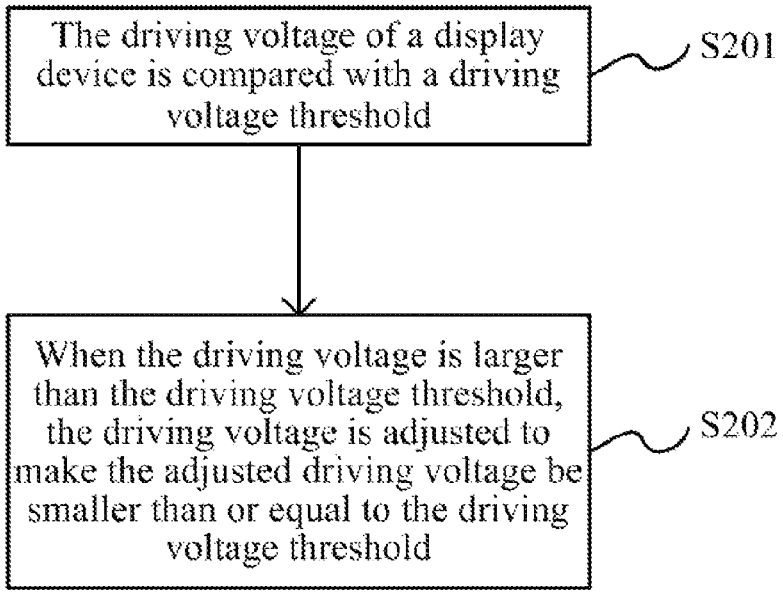
FIG. 2 is a simplified flow schematic diagram of a method of adjusting display device driving voltage provided by an embodiment of the present invention.

As shown in FIG. 2, a method of adjusting display device driving voltage provided by an embodiment of the present invention comprises the following steps:

S201. comparing the driving voltage of a display device with a driving voltage threshold;

S202. when the driving voltage is larger than the driving voltage threshold, adjusting the driving voltage to make the adjusted driving voltage be smaller than or equal to the driving voltage threshold.

Specifically, display images under different driving voltages are tested, wherein the higher the driving voltage of the display device, the severer the sliding tail unevenness (Trace Mura) is, a special display image is determined according to an empirical value, the display image is corresponding to a grey scale value, a driving voltage value corresponding to the grey scale is set as the driving voltage threshold, for example, the voltage value of the driving voltage threshold is R, slight Trace Mura is detected under the driving voltage R, and when the driving voltage is larger than R, the display device shall have severe Trace Mura, wherein the voltage value R of the driving voltage threshold is a driving voltage value corresponding to 60% transmittance in a voltage-transmittance curve, thereby guaranteeing that the display quality of the display device is not affected.

Before the driving voltage of the display device is adjusted, the driving voltage of the display device is firstly compared with the driving voltage threshold, when the driving voltage is larger than the driving voltage threshold, the driving voltage is adjusted to make the adjusted driving voltage be smaller than or equal to the driving voltage threshold. It is to be appreciated that there are various way of implementing methods described above. For example, the threshold value comparison can be based on driving voltage or display output.

Figure 3:
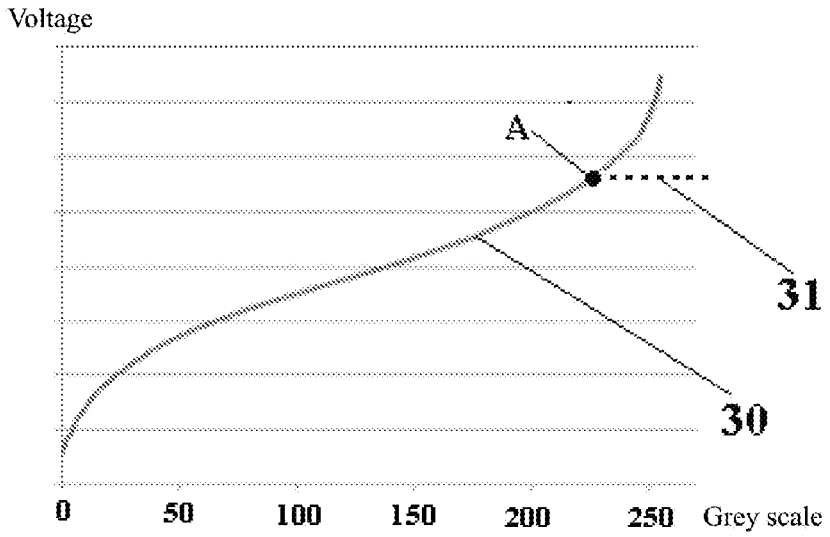
FIG. 3 is a grey scale-voltage curve graph corresponding to a method of adjusting display device driving voltage provided by an embodiment of the present invention.

According to certain embodiments, driving voltage is compared against a threshold voltage. The value of driving voltage larger than the preset driving voltage threshold is adjusted to the driving voltage threshold to make the adjusted driving voltage be equal to the driving voltage threshold. As shown in FIG. 3, the voltage value corresponding to the cross point A of a curve 30 and a curve 31 is the driving voltage threshold, the voltage value at the point is R, in an specific embodiment of the present invention, grey scale corresponding to a point higher than the cross point A is named as high grey scale, wherein the curve 30 expresses an unadjusted grey scale-voltage curve, the curve 31 expresses a grey scale-voltage curve corresponding to the high grey scale adjusted by the method in a specific embodiment of the present invention, as shown in the figure, when the driving voltage is driven by the method 1 in an specific embodiment of the present invention, the voltage lower than the driving voltage threshold is constant, only the driving voltage higher than the driving voltage threshold is reduced to the driving voltage threshold, at this time, the grey scale corresponding to voltage value higher than the driving voltage threshold displays distortion, however, the effect of the distorted grey scale when displaying an actual image is small, and the Trace Mura shall be obviously improved.

Figure 4:
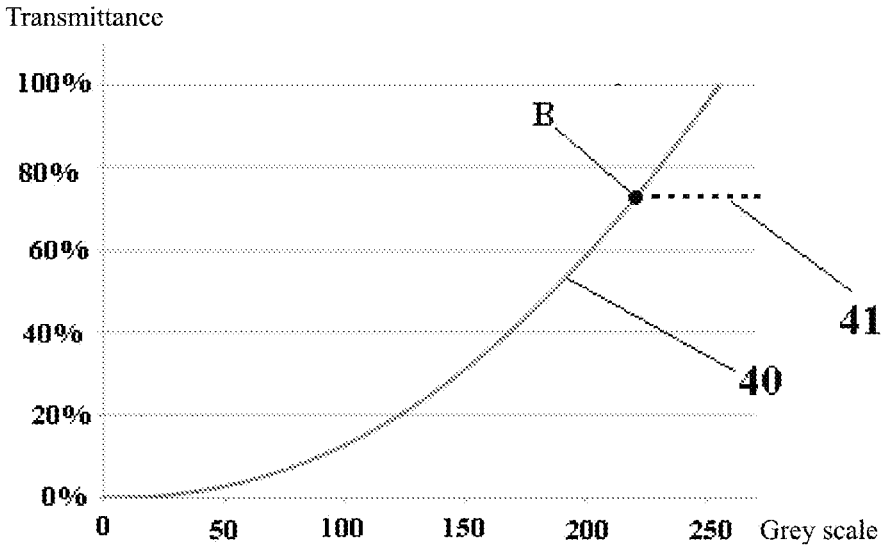
FIG. 4 is a transmittance-voltage curve graph corresponding to a method of adjusting display device driving voltage provided by an embodiment of the present invention.

FIG. 4 is a transmittance-grey scale curve, namely, a gamma curve, the driving voltage of the grey scale corresponding to the cross point B of a curve 40 and a curve 41 is R, wherein the curve 40 expresses an unadjusted transmittance-grey scale curve, the curve 41 expresses a transmittance-grey scale curve of high grey scales adjusted by the method in a specific embodiment of the present invention, as shown in the figure, the grey scale transmittance at the high grey scale adjusted by method 1 in a specific embodiment of the present invention is slightly reduced, the brightness is uniform with the brightness of the grey scale corresponding to the cross point B, at this time, the display of the high grey scale is distorted, however, the visual perception caused by the distortion under high brightness is unobvious, yet the Trace Mura is obviously improved, so that method 1 in an specific embodiment of the present invention is named as high grey scale decompression manner drive.

In various embodiments, a gamma curve is used in adjusting driving voltage. According to the driving voltage threshold, a gamma curve is selected from at least two preset gamma curves for adjusting the driving voltage so as to make the adjusted driving voltage be smaller than or equal to the driving voltage threshold, wherein the highest driving voltage of the selected gamma curve is closest to the driving voltage threshold. When the driving voltage is adjusted by the method, different gamma curves are corresponding to different voltage values, so that the adjusted voltage lower than the driving voltage threshold and the adjusted voltage higher than the driving voltage threshold shall change, the Trace Mura of the display device can be effectively improved without loss of grey scale after the driving voltage is adjusted by the method, for example, the grey scale of the display device is 256 before the adjustment, the grey scale of the display device is still 256 after the adjustment, yet the driving voltage corresponding to the adjusted 256 grey scale is smaller than or equal to the driving voltage threshold.

Preferably, the method further comprises the following steps before comparing the driving voltage of the display device with the driving voltage threshold:

detecting a triggering signal, and comparing the driving voltage of the display device with the driving voltage threshold when detecting the triggering signal.

Specifically, the Trace Mura is pressing unevenness caused by pressing or paddling in touch operation, and the Trace Mura shall appear in the pressing or paddling region when a liquid crystal display module with touch control function senses a pressing or paddling triggering signal. Method 1 or method 2 in a specific embodiment of the present invention can be used for adjusting the driving voltage to effectively improve the Trace Mura. In order to further reduce the effect of the driving voltage on the display images, the triggering signal is firstly detected before the driving voltage is compared with the driving voltage threshold, the driving voltage is compared with the driving voltage threshold when the triggering signal is detected, method 1 or method 2 provided by a specific embodiment of the present invention is used for adjusting the driving voltage after the comparison operation, when no triggering signal is detected, the driving voltage of the display device is unnecessary to be adjusted, the display device is driven according to a common manner, so that a touch control state and a non-touch control state can be judged by detecting the triggering signal, and different driving schemes are adopted at the touch control state and the non-touch control state to avoid display performance reduction caused by voltage change.

Particularly, since the Trace Mura appears in the pressing or paddling region, when the display device receives the triggering signal and adjusts the driving voltage, voltage threshold value or the gamma curve can be used for adjusting the driving voltage only in the pressing or paddling touch control region, the rest regions are driven according to the common manner, and a touch control computing method in the prior art can be used for determining the X, Y coordinates of the pressing or paddling region, which shall not be repeated here. Specific embodiments of the present invention are not limited to a touch control display device provided with a touch screen, but are also applicable to a display device capable of sensing touch control signals, for example, a semiconductor integrated circuit capable of sensing the touch control signals is arranged in the display device.

Figure 5:
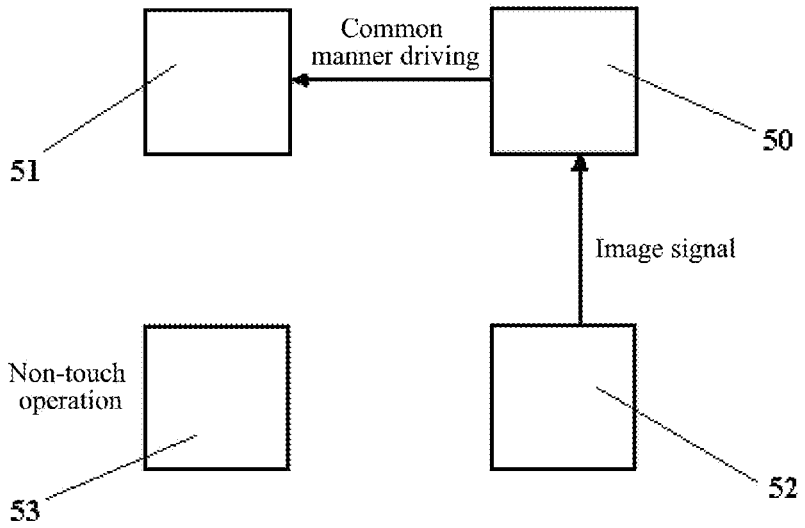
FIG. 5 is a simplified schematic diagram of a driving manner of a display device provided by an embodiment of the present invention in non-touch operation.
Figure 6A:
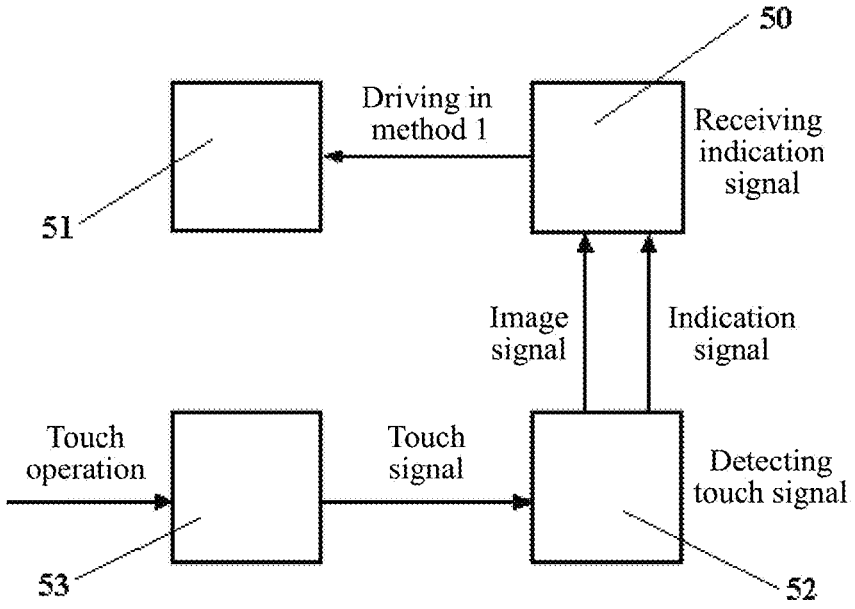
FIG. 6(*a*) and FIG. 6(*b*) are simplified schematic diagrams of a driving manner of a display device provided by an embodiment of the present invention in touch operation.
Figure 6B:
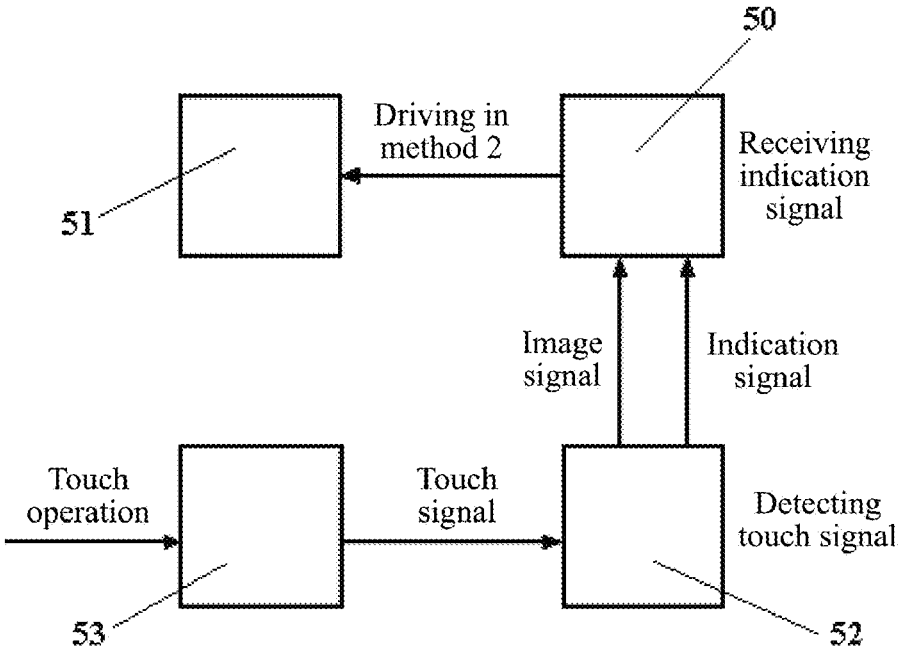

As shown in FIG. 5, FIG. 6(*a*) and FIG. 6(*b*), an embodiment of the present invention further provides a display device, the display device comprises a driving unit 50 and a display panel 51. The driving unit 50 is configured to compare the driving voltage of the display device with a driving voltage threshold, and to adjust the driving voltage to make the adjusted driving voltage be smaller than or equal to the driving voltage threshold when the driving voltage is larger than the driving voltage threshold. The display panel 51 is configured to display under the drive of the driving voltage adjusted by the driving unit 50.

Preferably, the device further comprises a control unit 52, the control unit 52 is configured to detect a triggering signal and to send an indication signal to the driving unit 50, wherein the indication signal is used for indicating the driving unit 50 to adjust the driving voltage driving the display panel 51 to display.

Preferably, the device further comprises a touch screen 53, and the touch screen 53 is configured to receive the triggering signal and to send the triggering signal to the control unit 52.

Specifically, as shown in FIG. 5, in non-touch operation, the control unit 52 only sends an image signal to the driving unit 50, and the driving unit 50 drives the display panel 51 in a common manner. As shown in FIG. 6(*a*), when a touch operation is conducted on the touch screen 53, the touch screen 53 sends a touch signal to the control unit 52, the control unit 52 detects the touch signal and sends the indication signal to the driving unit 50, and meanwhile, the control unit 52 sends the image signal to the driving unit 50, the driving unit 50 receives the indication signal, compares the driving voltage with the driving voltage threshold and reduces the driving voltage higher than the preset driving voltage threshold to the driving voltage threshold when the driving voltage is larger than the driving voltage threshold so as to make the adjusted driving voltage be smaller than or equal to the driving voltage threshold, namely, method 1 provided by a specific embodiment of the invention is used for driving the display panel 51. As shown in FIG. 5 and FIG. 6(*a*), the display device is driven by method 1 provided by a specific embodiment of the invention at the touch control state and is driven in the common manner at the non-touch control state, the two modes can be switched in real time, at this time, the Trace Mura can be improved, and meanwhile, the display quality reduction caused by voltage reduction can be alleviated.

In addition, as shown in FIG. 6(*b*), the driving unit 50 receives the indication signal and compares the driving voltage with the driving voltage threshold, when the driving voltage is larger than the driving voltage threshold, the driving unit selects a gamma curve, whose highest driving voltage is closest to the driving voltage threshold, from at least two preset gamma curves according to the driving voltage threshold to adjust the driving voltage so as to make the adjusted driving voltage be smaller than or equal to the driving voltage threshold, namely, the display panel 51 is driven by method 2 provided by a specific embodiment of the invention. As shown in FIG. 5 and FIG. 6(*b*), the display device is driven by method 2 provided by a specific embodiment of the invention at the touch control state and is driven in the common manner at the non-touch control state, the two modes can be switched in real time, at this time, the Trace Mura can be improved, and multiple gamma curves are switched to avoid such problems as maximal brightness reduction, contrast reduction and high grey scale distortion and avoid continuous effect on the display quality.

It is to be appreciated embodiments of the present invention can implemented in various ways. An embodiment of the present invention provides a method of adjusting display device driving voltage and a display device, which are used for improving pressing unevenness (Trace Mura) of the display device caused by pressing or paddling.

According to a method of adjusting display device driving voltage provided by an embodiment of the present invention, the method comprises the following steps: comparing the driving voltage of a display device with a driving voltage threshold; and when the driving voltage is larger than the driving voltage threshold, adjusting the driving voltage to make the adjusted driving voltage be smaller than or equal to the driving voltage threshold.

According to the method of adjusting display device driving voltage provided by an embodiment of the present invention, when the driving voltage is larger than the driving voltage threshold, the driving voltage is adjusted to make the adjusted driving voltage be smaller than or equal to the driving voltage threshold, and Trace Mura is improved by changing the driving voltage of the display device without changing the panel.

An embodiment of the present invention further provides a display device, the display device comprises a driving unit and a display panel, the driving unit is configured to compare the driving voltage of the display device with a driving voltage threshold, and to adjust the driving voltage to make the adjusted driving voltage be smaller than or equal to the driving voltage threshold when the driving voltage is larger than the driving voltage threshold; and the display panel is configured to display under the drive of the driving voltage adjusted by the driving unit.

Various modifications and variations may be made by those skilled in the art without departing from the spirit and scope of the present invention. Embodiments of the present invention is also intended to encompass these modifications and variations thereto so long as these modifications and variations come into the scope of the claims of the present invention and their equivalents.

What is claimed is:

1. A method of adjusting display device driving voltage, comprising:

in response to receiving a driving voltage of a display device, comparing the driving voltage with a driving voltage threshold to determine whether the driving voltage is larger than the driving voltage threshold, wherein the sliding tail unevenness (Trace Mura) of the display device corresponding to driving voltages higher than the driving voltage threshold exceeds predetermined acceptable Trace Mura for the display device; and when it is determined that the driving voltage is larger than the driving voltage threshold, adjusting the driving voltage to make the driving voltage smaller than or equal to the driving voltage threshold such that Trace Mura for the display device is reduced;

wherein adjusting the driving voltage to make the driving voltage smaller than or equal to the driving voltage threshold comprises:

selecting a gamma curve from at least two preset gamma curves according to the driving voltage threshold to adjust the driving voltage to make the driving voltage smaller than or equal to the driving voltage threshold, wherein a highest driving voltage on the selected gamma curve is closest to the driving voltage threshold.

2. The method according to claim 1, wherein liquid crystal transmittance corresponding to the value of the driving voltage threshold is larger than 60% of the liquid crystal transmittance in the display device.

3. The method according to claim 1, wherein before comparing the driving voltage of the display device with the driving voltage threshold, the method further comprises:

detecting a triggering signal indicating a touch operation by a user; and, wherein comparing the driving voltage of the display device with the driving voltage threshold for reducing Trace Mura of the display device only when the triggering signal is detected.

4. A display device, comprising a processor, a memory and a display panel, wherein the memory is configured to store codes of a computer program and the processor is configured to execute the computer program to:

in response to receiving a driving voltage of a display device, compare a driving voltage of the display device with a driving voltage threshold to determine whether the driving voltage is larger than the driving voltage threshold, wherein the sliding tail unevenness (Trace Mura) of the display device corresponding to driving voltages higher than the driving voltage threshold exceeds predetermined acceptable Trace Mura for the display device, and adjust the driving voltage to make the driving voltage smaller than or equal to the driving voltage threshold such that Trace Mura for the display device is reduced, when it is determined that the driving voltage is larger than the driving voltage threshold; and the display panel is configured to display based on the driving voltage adjusted by the driving unit;

wherein the processor configured to adjust the driving voltage to make the driving voltage smaller than or equal to the driving voltage threshold is configured to:

select a gamma curve from at least two preset gamma curves according to the driving voltage threshold to adjust the driving voltage to make the driving voltage smaller than or equal to the driving voltage threshold, wherein a highest driving voltage on the selected gamma curve is closest to the driving voltage threshold.

5. The display device according to claim 4, further comprising a touch screen, wherein the touch screen is configured to receive a triggering signal.

6. The display device according to claim 5, the processor is further configured to detect the triggering signal indicating a touch operation by a user and adjust the driving voltage for driving the display panel to display when the triggering signal is detected.

7. The display device according to claim 5, wherein a touch control region is defined by the triggering signal, and the processor is configured to only adjust the driving voltage of the touch control region of the display panel.

* * * * *